US006354363B1

(12) United States Patent
Perrin et al.

(10) Patent No.: US 6,354,363 B1
(45) Date of Patent: Mar. 12, 2002

(54) INGOT MOULD WITH MULTIPLE ANGLES FOR LOADED CONTINUOUS CASTING OF METALLURGICAL PRODUCT

(75) Inventors: Eric Perrin, Aix en Provence; Gèrard Perrin, Kuntzig; Cosimo Salaris, Montigny les Metz; Howard Weisseldinger, Rombas, all of (FR)

(73) Assignees: Usinor, Puteaux (FR); Societe Anonyme des Forges et Acieries de Dilling, Sarre (DE)

( * ) Notice: Subject to any disclaimer, the term of this patent is extended or adjusted under 35 U.S.C. 154(b) by 0 days.

(21) Appl. No.: 09/622,228

(22) PCT Filed: Dec. 16, 1999

(86) PCT No.: PCT/EP99/03166

§ 371 Date: Sep. 25, 2000

§ 102(e) Date: Sep. 25, 2000

(87) PCT Pub. No.: WO00/37197

PCT Pub. Date: Jun. 29, 2000

(30) Foreign Application Priority Data

Dec. 18, 1998 (FR) ..... 98 16055

(51) Int. Cl.[7] ..... B22D 11/124; B22D 11/00
(52) U.S. Cl. ..... 164/444; 164/487
(58) Field of Search ..... 164/443, 444, 164/418, 487

(56) References Cited

U.S. PATENT DOCUMENTS 3,515,202 A * 6/1970 Bick et al. ..... 164/89
5,040,595 A * 8/1991 Wagstaff ..... 164/487
5,148,856 A * 9/1992 Mueller et al. ..... 164/487
5,325,910 A * 7/1994 Schneider et al. ..... 164/472
5,431,214 A * 7/1995 Ohatake et al. ..... 164/444
5,582,230 A * 12/1996 Wagstaff et al. ..... 164/483
5,685,359 A * 11/1997 Wagstaff et al. ..... 164/444
6,050,324 A * 4/2000 Jolivet et al. ..... 164/415

FOREIGN PATENT DOCUMENTS

| | | |
|---|---|---|
| EP | 0 620 062 | 6/1998 |
| FR | 2 747 062 | 10/1997 |
| FR | 2 747 063 | 10/1997 |

* cited by examiner

*Primary Examiner*—Tom Dunn
*Assistant Examiner*—Len Tran
(74) *Attorney, Agent, or Firm*—Young & Thompson

(57) ABSTRACT

The invention concerns an ingot mould comprising in succession, in the direction for extracting the metallic product to be cast (7): a preheater (5) made of noncooled refractory material acting as reservoir for the melting metal to be cast and a standard cooled tubular metal element (6) for solidifying the metal. A slot (18) for injecting the shearing gas (for example Ar) is arranged between the preheater (5) and the metal clement (6) so as to emerge on the ingot mold internal periphery. The injection slot comprises means (17) for reducing the gas flow in each of the ingot mold angles, preferably formed by obstructing elements. The invention enables to reduce, even eliminate, defects encountered along the edges of the solidified cast products.

10 Claims, 3 Drawing Sheets

INGOT MOULD WITH MULTIPLE ANGLES FOR LOADED CONTINUOUS CASTING OF METALLURGICAL PRODUCT

BACKGROUND OF THE INVENTION

The invention relates to a head of a mould for the hot-top continuous casting of a metallurgical product, such as a steel bloom, billet or slab.

In the case of the continuous casting of a metallurgical product, a molten metal is poured into an upper part or head of a mould having a vertical general disposition and extracted from this mould, via the bottom, is a peripherally solidified product.

The process called "hot-top continuous casting", which in fact constitutes an improvement of the general continuous casting process, is used in such a way that the meniscus (the free surface of the cast metal) is transferred upstream of the level where the solidification of the metal inside the head of the mould starts. In order to carry out the hot-top continuous casting process, the usual copper tubular element of the mould, cooled by internal circulation of cooling water, is surmounted, perfectly contiguously, by an uncooled feed head made of thermally insulating refractory material, serving as a reservoir of molten metal fed by the pouring jet from a tundish placed a short distance above it. By virtue of this novel type of construction of the mould head, the liquid-metal meniscus is established therein, during the casting run, within the refractory feed head, whereas the solidification of the metal starts only level with the cooled metal tubular element which, as in conventional continuous casting, calibrates the cast product in terms of shape and size. Consequently, the stirring of the liquid metal due to the pouring jet is limited within the feed head. In the solidification space defined by the copper tubular element placed below, the flow of cast metal may thus be maintained in a relatively calm hydrodynamic state, thereby making it possible in particular to even out the solidification profile of the steel in contact with the cooled copper wall all around the inner perimeter of the mould. However, in order to use such a process satisfactorily, it is necessary to avoid any premature solidification of the cast metal in the feed head so as to be able to ensure that the solidification starts lower down, precisely at the point of contact with the cold copper wall.

To do this, it has already been proposed to leave a gap of very small width (less than 1 mm and generally about 0.2 mm) between the refractory feed head and the copper tubular element and to inject, via this slot, a fluid, generally an inert gas such as argon, into the mould around its inner periphery. In order to ensure gas flow at any point in the slot, the latter is fed with pressurized gas via a distribution chamber which surrounds it.

This injection of gas has the effect of shearing the heterogeneous parasitic solidified film which could form above, against the inner wall of the refractory feed head, and thus create conditions conducive to a sharp and even onset of solidification in the cooled copper element located just below.

In the case of non-circular moulds, in other words in the case of moulds provided with a cooled tubular element quadrangular in shape (for casting slabs, blooms or billets of square cross section, for example) or more generally multiangular in shape (for casting blanks already having the shape of the desired end product), it has been observed, on the cast products after complete solidification, that there are solidification defects along the edges, such as longitudinal cracks, exfoliations, etc., defects whose origin can be identified as being a lack of solidified metal at these points already in the mould, and therefore at the very moment that the solid shell forms.

SUMMARY OF THE INVENTION

The object of the present invention is specifically to provide a solution making it possible to reduce, or even to completely eliminate, these solidification defects in the corners of the cast products obtained.

For this purpose, the subject of the invention is a mould for the hot-top continuous casting of molten metals, comprising a cooled metal tubular element of quadrangular shape, defining the shape and size of the cast product and in which the molten metal solidifies on contact with the cooled inner metal wall, the said cooled tubular element being surmounted by an uncooled feed head made of thermally insulating refractory material defining a reservoir of molten metal to be solidified, a slot for injecting a shearing fluid (especially a pressurized inert gas, preferably such as argon) around the inner periphery of the mould being provided between the cooled metal element and the refractory feed head, the said mould being characterized in that it is provided with means for reducing the flow of shearing fluid in the corners.

Preferably, these means consist of an element forming an obstacle to the flow of the gas in the injection slot, the said element being placed in each of the corners of the slot.

The invention results from the following considerations. In order to obtain a satisfactory shearing effect on the flow of gas injected at the base of the feed head, it is necessary to maintain a gas flow rate all along the slot so that there are no dead regions where undesirable solidification fragments would therefore persist. However, even if the slot is fed from a peripheral pressurized-gas manifold, and therefore ensuring that head losses are equal and, consequently, that there is a linear emerging flow with a constant flow rate over the entire length of the slot, an injected-gas flow rate equal at every point around the perimeter of the cast product is not obtained. This is because there is a greater flow rate of gas in the corners of the mould due to the fact that, since the slot is, of course, of the same rectangular shape as the mould, the inside of the latter is fed with gas in two directions in its corner regions. This greater flow rate in the corners results, in the region of the slot, and therefore in particular in the upper part of the cooled copper element located just below, in an overpressure which can cause local separation of the solidified shell from the cold copper wall at the edges of the cast product. It is these separations which, because of the collapse in the effectiveness of the product cooling in the corners which results, are responsible for solidification-disturbing phenomena of the "lack of solidified metal" type, which phenomena are then manifested, on the cast product obtained, by solidification defects in the corners along the edges.

In order to make the invention more clearly understood, a description will now be given, by way of non-limiting example and with reference to the figures appended hereto, of a mould for the hot-top continuous casting of a steel billet of square shape according to the invention.

DESCRIPTION OF THE PREFERRED EMBODIMENTS

Figure 1:
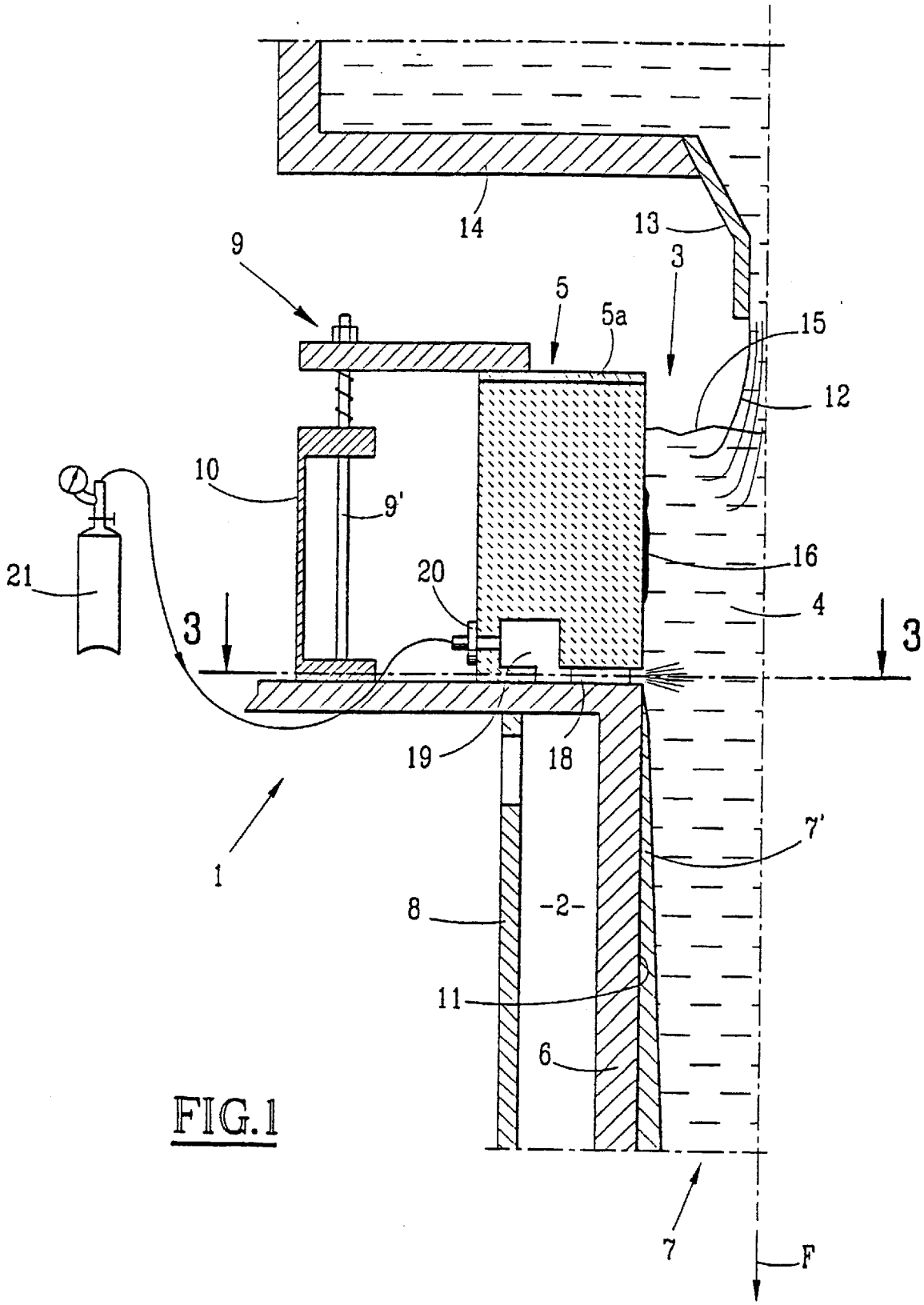
FIG. 1 is a schematic half-view, in axial cross section, of the upper part of the mould on the plane 1—1 in FIG. 3.
Figure 2:
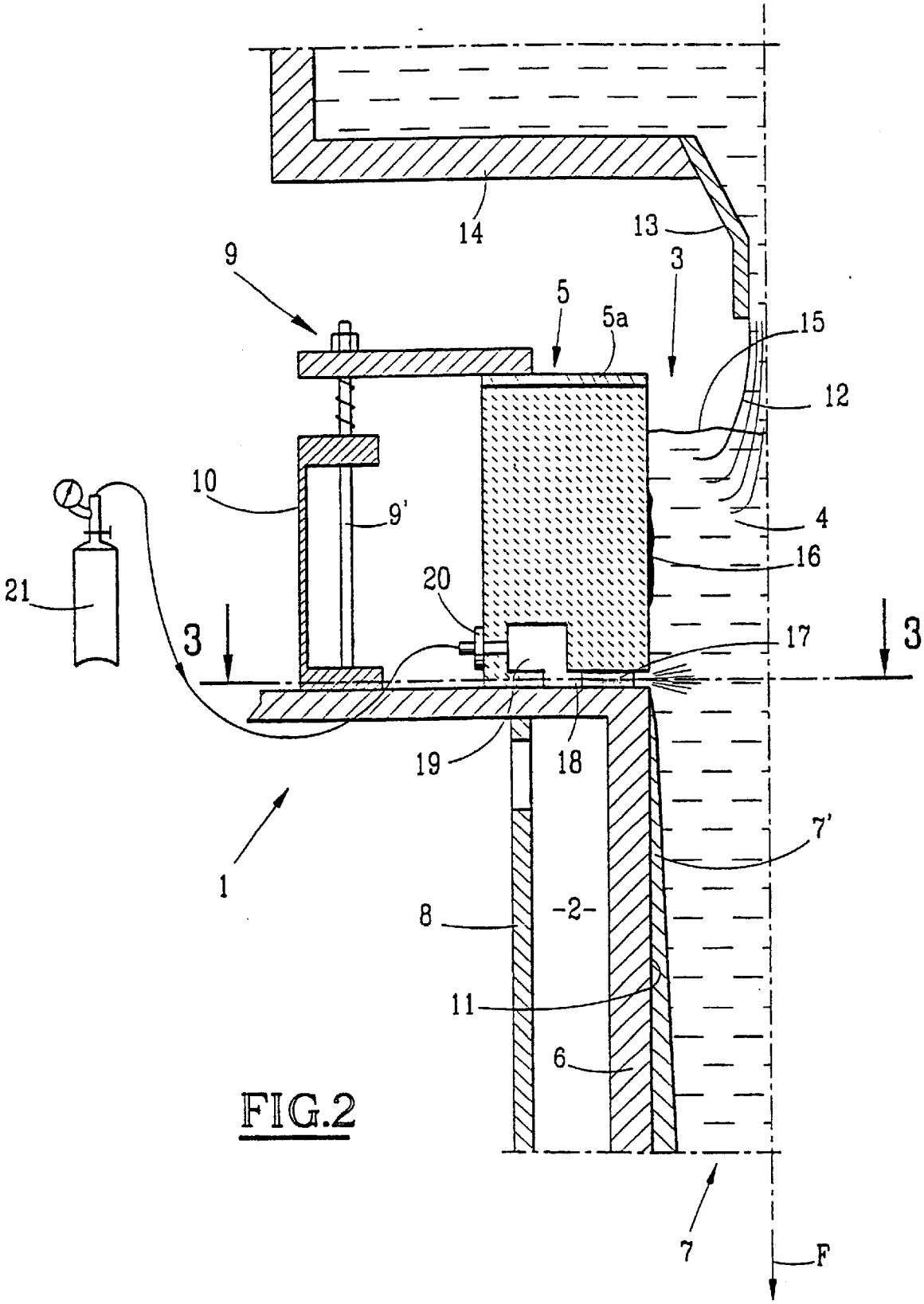
FIG. 2 is a schematic half-view in axial cross section of the upper part of the mould on the plane 2—2 in FIG. 3.

FIG. 1 and FIG. 2 show the upper part of a hot-top continuous casting mould denoted overall by the reference number 1, which has a cooled copper tubular element 6 extended upwards, and completely contiguously in order to prevent any infiltration of molten metal, by a feed head 5 made of uncooled refractory material.

The cooled metal element 6 and the refractory feed head 5 define, in their internal part, an internal casting space 3 into which a molten metal 4, such as steel, is poured and solidifies. As may be seen in FIG. 3, the internal casting space 3 has a cross section in the form of a square with rounded corners, the radius of which has been exaggeratedly increased on purpose in order to more clearly show the characteristic elements making up the invention, which will be explained again below.

It will be noted that the cooled copper tubular element 6 forms the main element of the mould. It is this element which, being vigorously cooled by an internal circulation of water (which takes place here in a space 2 left between the element 6 and a metal jacket 8 which surrounds the latter at some distance therefrom), conventionally serves as a crystallizer, against the inner wall 11 of which the molten steel 7 solidifies, forming firstly a first shell 7' as soon as the steel first comes into contact with the cold copper 11. Next, as the cast product progresses downwards in the mould in the direction indicated by the arrow F, this shell, under the effect of the intense heat pumping due to the vigorous cooling of the copper element 6, steadily thickens. The solidification of the cast product 7 thus progresses from the periphery towards the central axis until complete solidification, which conventionally occurs about ten metres below the mould, water sprays being provided for this purpose following the mould in order to immediately spray the surface of the cast product to be cooled.

As regards the feed head 5, which is a specific component of so-called "hot-top" casting, its essential function is to serve as a reservoir 4 of molten metal. This metal arrives as a pouring jet 12 coming from a tundish 14, placed a short distance above it, via a nozzle 13 mounted on the outlet orifice of the tundish. The reservoir 4 constitutes a buffer mass, which plays a key role with regard to the hydrodynamics by allowing the often violent stirring of liquid metal due to the great momentum of the steel jet 12 to freely develop therein and therefore to be damped therein. Thus, the liquid steel which then enters the crystallizer 6, in order to solidify in it, is in a much calmer state and, above all, far from the meniscus 15, the stirring of which is often the cause of solidification heterogeneities in the outermost shell in a conventional continuous casting mould. Beneath the reservoir 4, the flow of the molten metal approaches "piston"-type flow, that is to say flow without a marked gradient in the velocity vector across the section, something which is extremely favourable to the proper execution of the solidification process.

As a general rule, but not shown in the figures, the feed head 5 made of refractory material has a main upper part made of a fibrous refractory material chosen for its thermal insulation properties so as to keep the reservoir of molten metal 4 in the liquid state, for example the material sold under the name A120K by the company KAPYROK, and a lower annular insert chosen to be made of a dense refractory material, such as SiAlON® in order to ensure the best mechanical integrity in the immediate vicinity of the cooled copper element 6 stressed by the onset of solidification.

It will be seen that the feed head is fastened, in a position well aligned with respect to the tubular element 6, by means of alignment pins, not shown, and of an assembling flange 9 with a tie rod 9', this flange bearing on a metal plate 5*a* covering the refractory part. A box 10 made of sheet metal is advantageously provided for the passage of the tie rods and in order to stiffen the assembly.

Despite the thermal insulation properties of the refractory material used for the feed head 5, parasitic solidified films 16 of cast metal, of greater or lesser extent, may form on the inner wall of the feed head. Even localized on the perimeter, they can be deleterious to correct solidification in the crystallizer 6 in so far as these fragments 16 may reach as far as level with the edge of the cooled element 6 where the solidification starts. In order to break, before this stage, any undesirable solidified film formed prematurely in the feed head, a shearing fluid is injected peripherally at the base of the feed head. In this regard, it would be preferable to use a gas, and even more preferably a gas which is chemically inert with respect to the cast metal, such as argon.

To this end, a narrow slot 18, for example with a width of about 0.2 mm, is provided between the feed head 5 and the cooled copper element 6. This slot opens freely towards the inside of the mould and emerges at its other end in a sealed annular chamber 19 provided in the feed head. This chamber 19, which runs all along the slot 18, serves to properly distribute the linear flow of gas that has to emerge from the slot. It is connected via a duct 20 to an external source 21 of pressurized gas. The slot 18 has an annular shape similar to the quadrangular shape of the mould, and therefore to that which the cast product 7 adopts once the shell has solidified within the copper element 6. In particular, it therefore has an outline with four corners, as shown in FIG. 3, where the rounded part of the corners has been deliberately exaggerated for the reasons mentioned above.

Because near each of the corners 3*a*, 3*b*, 3*c* and 3*d* of the mould the shearing gas introduced into the casting space 3 is supplied from two sides of the slot 18 at right angles, the two-directional and convergent feed in the corner regions of the casting space 3 means that more gas is blown into these regions, entailing a risk of localized separation of the cast metal from the copper wall 11 at the upper edge of the latter, at the point where the outermost shell forms, and, consequently, means that there is insufficient solidified metal, compared with the rest of the perimeter, in the region of the edges of the cast product during solidification within the copper element 6, because of the lack of effective cooling of the product at these points.

Figure 3:
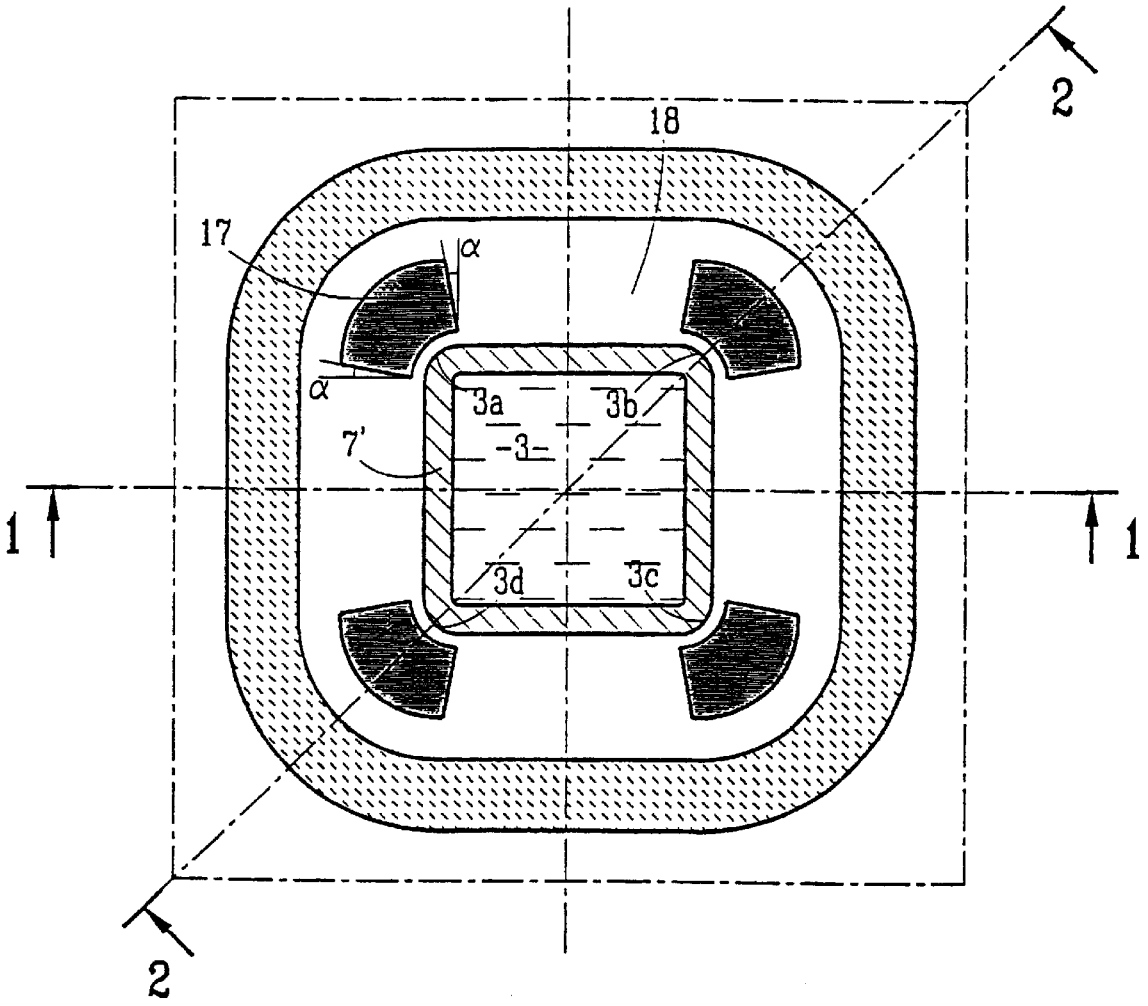
FIG. 3 is a top view of the lower part of the mould on the plane 3—3 in FIG. 1 or in FIG. 2.

In order to prevent this excess injection of gas into the corner regions, elements for obstructing the flow of the gas are placed, according to the invention, in the corners of the slot 18, as may be seen in FIGS. 2 and 3.

The obstructing elements 17, placed in corners of the gap 18, may consist of bundles of flexible fibrous refractory material which, after the feed head has been clamped against the top of the metal element 6, locally block the passage, by flattening, from the outside towards the inside of the mould. Each of the obstructing elements 17 is then advantageously bounded towards the outside by the internal perimeter of the distribution chamber 19, towards the inside by a corner of the casting space 3, and laterally by two straight sides converging towards the casting space 3 and making an angle $\alpha$ with the perpendicular to the plane internal surface of the casting space 3, at the corresponding end of the rounded corner 3*a* (or 3*b*, 3*c*, 3*d*, respectively) of the casting space which delimits, inwardly, the obstructing element 17.

If the rounded corner of the casting space of the mould has a radius of about 6.5 mm, the width of the obstructing element 17 in its narrowest region, adjacent to a corner of the casting space, must preferably be between 4 and 6.5 mm. If this width is less than 4 mm, the localized excess flow of gas injected into the corner is not properly eliminated. If the width is greater than 6.5 mm, there is a region near the corner where there is no linear flow of injected gas.

Moreover, the angle a between the straight side of the obstructing element 17 and the perpendicular to the internal surface of the casting space will advantageously be between 0 and 45°. Outside these values of the inclination of the sides of the obstructing element 17, the linear flow of injected gas, that is to say the flow per unit length of the inner perimeter of the mould level with the slot 18, becomes zero in a region near the corners.

It has been found that a value of the angle $\alpha$ of about 20° makes it possible to obtain a constant linear flow around the inner perimeter of the mould in the case of the casting of products of rectangular or square shape. In certain cases, depending on whether the shape of the products to be cast is more or less complex, the two straight lateral sides of the obstructing elements 17 may make different angles $\alpha$ and $\alpha'$ with the perpendiculars to the plane internal surface of the internal casting space 3 at the ends of the corners.

By using elements for obstructing the slot 18 which have the geometrical and dimensional characteristics given above, it is possible to obtain a linear flow of inert gas into the internal casting space, at the slot 18, which is perfectly constant. In this way, the solidification defects observed along the edges of the cast product once it has solidified are eliminated.

The invention is not limited to the embodiment which has been described. For example, it is possible to use, as the element obstructing the slot 18 in its corner regions, materials different from refractory fibres. These elements may be completely impermeable to the gas, or else slightly porous.

It is also possible to obstruct the slot 18 in its corner regions and to eliminate the gas flow in these regions by making the feed head 5 slightly thicker in the corner regions extending over the width of the slot 18, between the internal casting space 3 and the distribution chamber 19. This additional thickness may be achieved by machining, for example by milling, the lower face of the feed head 5 adjacent to the element 6. Conversely, the additional thickness in the corner may be obtained on the element 6, that upper face of which, facing the feed head 5, would be machined for this purpose. Preferably, the region of additional thickness will have a shape similar to the shape of the obstructing elements 17 as illustrated in FIG. 3. This additional thickness may be preferably about 0.2 mm.

It is also possible to partially obstruct the distribution chamber 19 in regions close to its corners, so as to limit or to eliminate the injection into the corner regions of the slot 18. The distribution chamber may be obstructed, for example, by introducing, into the corner regions of the distribution chamber, plugs penetrated by channels in the direction of flow of the gas in the distribution chamber or else plugs having a degree of porosity.

The invention applies to any multiangular mould head for the hot-top continuous casting of a metallurgical product, such as a billet, a bloom or a slab, or blanks of a shape already close to the end product, (beams, rails, various sections, etc.) provided that the head satisfies its definition given by the appended claims. Moreover, it may be applied both in the case of the continuous casting of steel and in the case of the continuous casting of non-ferrous metals.

What is claimed is:

1. Mould for the hot-top continuous casting of molten metals, comprising a cooled metal tubular element (6) of multiangular shape, defining the shape and the size of a cast product and in which the molten metal (7) solidifies on contact with a cooled inner metal wall (11), said cooled tubular element being surmounted by an uncooled feed head (5) made of thermally insulating refractory material defining a reservoir of molten metal to be solidified, a slot (18) for injecting a shearing fluid around the inner periphery of said mould being provided between said cooled metal element (6) and said refractory feed head (5), wherein said mould comprises means (17) for reducing the flow of shearing fluid in a pluarality of corners located in said slot.

2. Mould according to claim 1, characterized in that the means for reducing the gas flow consist of elements (17) for locally obstructing the flow in the slot (18).

3. Mould according to claim 2, characterized in that the obstructing elements (17) each consist of a bundle of compressed fibrous refractory between the feed head (5) and the cooled tubular element (6) and each is placed in a corner region **(3*a* . . . 3*d*) of the slot (18)**.

4. Mould according to claim 2, characterized in that the elements (17) for obstructing each of said corner regions of the slot (18) have two straight lateral sides between a distribution chamber (19) and a corner **(3*a*, 3*b*, 3*c*, 3*d*) of an internal surface of an internal casting space (3) converging towards the casting (3) and each making an angle of between 0° and 45° with a perpendicular to the internal casting surface (3) near a corner (3*a*, 3*b*, 3*c*, 3*d*) of the surface of the internal casting space (3)**.

5. Mould according to claim 2, and having rounded corners with a radius of about 6.5 mm, characterized in that the obstructing elements (17) have a face, which faces the casting space (3), with a width of between 4 and 6.5 mm.

6. Mould according to claim 1, characterized in that the means for reducing the gas flow consist of elements for partially obstructing the corners of the injection slot (18).

7. Mould according to claim 3, characterized in that the elements (17) for obstructing each of said corner regions of the slot (18) have two straight lateral sides between a distribution chamber (19) and a corner **(3*a*, 3*b*, 3*c*, 3*d*) of an internal surface of an internal casting space (3) converging towards the casting (3) and each making an angle of between 0° and 45° with a perpendicular to the internal casting surface (3) near a corner (3*a*, 3*b*, 3*c*, 3*d*) of the surface of the internal casting space (3)**.

8. Mould according to claim 3, and having rounded corners with a radius of about 6.5 mm, characterized in that the obstructing elements (17) have a face, which faces the casting space (3), with a width of between 4 and 6.5 mm.

9. Mould according to claim 4, and having rounded corners with a radius of about 6.5 mm, characterized in that the obstructing elements (17) have a face, which faces the casting space (3), with a width of between 4 and 6.5 mm.

10. Mould according to claim 7, and having rounded corners with a radius of about 6.5 mm, characterized in that the obstructing elements (17) have a face, which faces the casting space (3), with a width of between 4 and 6.5 mm.

* * * * *

UNITED STATES PATENT AND TRADEMARK OFFICE

CERTIFICATE OF CORRECTION

PATENT NO. : 6,354,363 B1
DATED : March 12, 2002
INVENTOR(S) : Eric Perrin et al.

It is certified that error appears in the above-identified patent and that said Letters Patent is hereby corrected as shown below:

Title page,
Item [86], the priority, change "PCT/EP9903166" to -- PCT/FR9903166 --.

Signed and Sealed this

Twentieth Day of August, 2002

*Attest:*

*Attesting Officer*

JAMES E. ROGAN
*Director of the United States Patent and Trademark Office*